US005965065A

United States Patent [19]

Powell

[11] Patent Number: 5,965,065

[45] Date of Patent: Oct. 12, 1999

[54] METHOD OF FILTERING X-RAYS

[76] Inventor: Stephen Forbes Powell, 730 Southview Way, Woodside, Calif. 94062

[21] Appl. No.: 08/823,883

[22] Filed: Mar. 17, 1997

Related U.S. Application Data

[63] Continuation-in-part of application No. 08/349,669, Dec. 5, 1994, abandoned.

[51] Int. Cl.[6] ..... F21V 9/00; F21V 9/06; G21K 3/00

[52] U.S. Cl. ..... 252/582; 252/588; 252/478; 378/156

[58] Field of Search ..... 252/582, 478, 252/588; 378/156, 34; 428/334; 548/343.5, 364.4, 365.1; 544/363, 364; 528/424

[56] References Cited

U.S. PATENT DOCUMENTS

| | | | |
|---|---|---|---|
| 4,246,054 | 1/1981 | Nester | 156/74 |
| 4,617,252 | 10/1986 | Cordes et al. | 430/272 |
| 4,927,909 | 5/1990 | Wadhwa et al. | 528/331 |
| 4,933,557 | 6/1990 | Perkins et al. | 250/505.1 |
| 4,960,486 | 10/1990 | Perkins et al. | 156/633 |
| 5,017,681 | 5/1991 | Wadhwa et al. | 528/342 |
| 5,114,579 | 5/1992 | Takigawa | 210/638 |
| 5,177,774 | 1/1993 | Suckewer et al. | 378/43 |
| 5,204,886 | 4/1993 | Dugdale | 378/34 |
| 5,204,887 | 4/1993 | Hayashida et al. | 378/43 |
| 5,222,113 | 6/1993 | Thieme et al. | 378/43 |
| 5,227,012 | 7/1993 | Brandli et al. | 156/643 |
| 5,261,977 | 11/1993 | Powell | 156/74 |
| 5,525,436 | 6/1996 | Savinell et al. | 429/30 |
| 5,567,550 | 10/1996 | Smayling | 430/5 |

FOREIGN PATENT DOCUMENTS 06324508 5/1993 Japan .

OTHER PUBLICATIONS

F. R. Powell, P. W. Vedder, J. F. Lindblom, and S. F. Powell, "Thin Film Filter Performance for Extreme Ultraviolet and X–ray Applications," *Opt. Eng.* 29, 614–624 (1990).

J. F. Lindblom, R.H. O'Neal, A. B. C. Walker, Jr., F. R. Powell, T. W. Berbee, Jr., R. B. Hoover, and S. F. Powell, "Multi–Spectral Solar Telescope Array IV: the soft x–ray and extreme ultraviolet filters," *Opt. Eng.* 30, 1134–1141 (1991).

M. Heppener and D. G. Simons, "A large aperture imaging gas scintillation proportional counter," in *X–Ray Instrumentation in Astronomy II*, L. Golub, ed., Proc. Soc. Photo–Opt. Instrum. Eng. 982, 139–146 (1988).

U. G. Briel, E. Pfeffermann, G. Hartner, and G. Hasinger, "X–ray Calibration of the ROSAT Position Sensitive Proportional Counter," in *X–ray Instrumentation in Astronomy II*, L. Golub, ed., Proc. Soc. Photo–Opt. Instrum. Eng. 982, 401–408 (1988).

R. B. Hoover, D. L. Shealy, B. R. Brinkley, P. C. Baker, T. W. Barbee, Jr., and A. B. C. Walker, Jr., "Development of the water window imaging x–ray microscope utilizing normal–incidence multilayer optics," *Opt. Eng.* 30, 1086–1093 (1991).

J. F. Seely in "Transmission filter for the 'water–window' wavelength region 23–44 Å," *Opt. Commun.* 70, 207–212 (1989).

(List continued on next page.)

*Primary Examiner*—Shean C. Wu

[57] ABSTRACT

There is a need in the field of x-ray optics for an oxygen-free polymeric filter. This is because the mass absorption coefficient of oxygen is greater than that of carbon at every energy in the soft x-ray region except for a narrow band between the oxygen k-edge at 543.1 eV and the carbon k-edge at 284.2 eV. This band of frequencies is known as the "water window." The present invention is a method of filtering x-rays with the use of a freestanding, thin film of a polymer, metal-polymer composite, mesh-supported polymer film, or mesh-supported metal-polymer composite where the polymeric component of the filter is a PBI or a PPQ. In accordance with the present invention, the soft x-ray transmission of a 2500 angstrom polybenzimidazole film was measured as 3 to 5% more transmissive than either the polyimide DuPont 2610D or the polycarbonate GE Lexan.

18 Claims, 3 Drawing Sheets

OTHER PUBLICATIONS

S. Nenonen, H. Sipilä, P. Jalas, and R. Mutikainen, "Soft x–ray windows for position sensitive proportional counters," in *EUV, X–Ray, and Gamma–Ray Instrumentation for Astronomy*, H. S. Hudson and O. H. Siegmund, eds., Proc. Soc. Photo–Opt. Instrum. Eng. 1344, 100–105 (1990).

S. F. Powell, M. J. Allen, and T. D. Willis in "Tin–polyimide and Indium–polyimide thin film composites as soft x–ray bandpass filters," *Appl. Opt.* 32, 4855–4859 (1993).

C. P. Wong, "Recent Advances in IC Passivation and Encapsulation: Process Techniques" in *Polymers for Electronic and Photonic Applications*, C. P. Wong, ed. (Academic Press, New York, 1993), pp. 202 and 187.

W. R. Hunter, "The preparation and use of unbacked metals films as filters in the extreme ultraviolet," *Phys. Thin Films* 7, pp. 43–114 (1973).

O.–P. Viitanen, S. Nenonen, P. Partanen, H. Sipilä, and R. Mutikainen, "X–ray windows for spaceborne detectors" in EUV, X–Ray, *and Gamma–Ray Instrumentation for Astronomy III*, O. H. W. Siegmund, eds., Proc. Soc. Photo–pt. Instrum. Eng. 1743, 245–251 (1992).

B. L. Henke, E. M. Gullikson, and J. C. Davis, "X–Ray Interactions: Photoabsorption, Scattering, Transmission and Reflection, 50–30,000 eV, Z=1–92," submitted to *Atomic Data and Nuclear Data Tables*, Mar., 1993.

*High Performance Polymers and Composites*, J. I. Kroschwitz, ed., (Wiley, New York, 1991), pp. 578–607 and 918–950.

S. R. Sandler and W. Karo *Polymer Synthesis*, (Academic Press, New York, 1992), chapters 3 and 9.

P. E. Cassidy, *Thermally Stable Polymers* ( Marcel Dekker, New York, 1980), Chapters 5–9.

E. J. Powers and G. A. Serad, "History and Development of Polybenzimidazole," *Symposium on the History of High Performance Polymers* (Am. Chem. Soc., New York, 1986).

A. M. Wilson, "Polyimide insulators for multilevels interconnections," *Thin Solid Films* 83, 145–163, 1981).

Polycarbonate (PC)

Polyimide (PI)

Polybenzimidazole (PBI)

Polyphenylquinoxaline (PPQ)

Polybenzoxazole (PBO)

METHOD OF FILTERING X-RAYS

CROSS-REFERENCE TO RELATED APPLICATIONS

This application is a continuation-in-part of Ser. No. 08/349,669, filed Dec. 5, 1994, now abandoned.

BACKGROUND OF THE INVENTION

1. Field of the Invention

This invention relates to a method of filtering x-rays using a freestanding thin film of a polymer, metal-polymer composite, mesh-supported polymer film, or mesh-supported metal-polymer composite. The filtering of x-rays in x-ray optics is done with the use of a "bandpass filter" that selects, or allows to pass, only a certain band of frequencies of the radiation that impinges on the filter, and in this invention the polymer is a polybenzimidazole (PBI) or a polyphenylquinoxaline (PPQ).

2. Prior Art

Freestanding, thin film composites of a metal and a polymer are utilized extensively in x-ray optics. In x-ray astronomy, such films were used to eliminate visible light from solar spectrographs nearly 30 years ago. Since that time they have served as bandpass filters for telescopes that operate in the extreme-ultraviolet and soft x-ray regions of the electromagnetic spectrum. A partial review of the materials that have been used in x-ray telescope filters was written by F. R. Powell, P. W. Vedder, J. F. Lindblom, and S. F. Powell in "Thin film filter performance for extreme ultraviolet and x-ray applications," *Opt. Eng.* 29, 614–624 (1990). An example of the use of filters in a specific telescope has been described by J. F. Lindblom, R. H. O'Neal, A. B. C. Walker, Jr., F. R. Powell, T. W. Barbee, Jr., R. B. Hoover, and S. F. Powell in "Multi-spectral solar telescope array IV: the soft x-ray and extreme ultraviolet filters," *Opt. Eng.* 30, 1134–1141 (1991).

Additionally, polymeric films have been used as entrance windows for proportional counter x-ray detectors. One example of their use in proportional counter windows was documented by M. Heppener and D. G. Simons in "A large aperture imaging gas scintillation proportional counter, " in *X-Ray Instrumentation in Astronomy II*, L. Golub, ed., Proc. Soc. Photo-Opt. Instrum. Eng. 982, 139–146 (1988); a second example was given by U. G. Briel, E. Pfeffermann, G. Hartner, and G. Hasinger in "X-ray calibration of the ROSAT position sensitive proportional counter," in *X-Ray Instrumentation in Astronomy II*, L. Golub, ed., Proc. Soc. Photo-Opt. Instrum. Eng. 982, 401–408 (1988).

Metal-polymer composite filters have a similar function in x-ray microscopy, where they transmit the bandpass of interest and filter out the unwanted longer wavelength radiation. An example of the use of a carbon-phthalocyanine filter in an x-ray microscope was presented by R. B. Hoover, D. L. Shealy, B. R. Brinkley, P. C. Baker, T. W. Barbee, Jr., and A. B. C. Walker, Jr. in "Development of the water window imaging x-ray microscope utilizing normal-incidence multilayer optics," *Opt. Eng.* 30, 1086–1093 (1991). A discussion of a tin-Formvar filter was given by J. F. Seely in "Transmission filter for the 'water-window' wavelength region 23–44 Å," *Opt. Commun.* 70, 207–212 (1989).

Additional uses of metal-polymer composites in x-ray optics have included pressure windows in synchrotron radiation facilities and x-ray lithography masks. In the present document, use of the term "x-ray filter" shall be construed to include every application in which a membrane is inserted into the optical path of x-ray or extreme ultraviolet radiation, including pressure windows.

Many types of polymers have been evaluated for the above-mentionned applications. These materials have widely varying structures, and include: 1) poly(vinyl formal) (Formvar, Shawinigan Resins Corp. and Monsanto), 2) poly(p-xylylene) (Parylene N, Union Carbide Corp.), 3) copolymers of vinyl chloride and vinyl acetate (VYNS, Union Carbide Corp.), and 4) polycarbonate (Lexan, General Electric Co.). Data have been accumulated for the cellulosic family comprising 5) cellulose acetate (Zapon) and 6) cellulose nitrate (Parlodion, Collodion). Other choices have been 7), poly(ethylene terephthalate) (Mylar), 8) poly(methyl methacrylate), and 9) polypropylene.

Polyimides have been assessed as potential candidates for proportional counter entrance windows by S. Nenonen, H. Sipilai, P. Jalas, and R. Mutikainen, "Soft x-ray windows for position sensitive proportional counters," in *EUV, X-Ray, and Gamma-Ray Instrumentation for Astronomy*, H. S. Hudson and O. H. Siegmund, eds., Proc. Soc. Photo-Opt. Instrum. Eng. 1344, 100–105 (1990). The thermal stability of an aromatic polymide distinguishes this class of polymers from its counterparts listed above. Polyimides are believed to possess superior mechanical properties as well, and for these reasons polyimides are being evaluated as the polymeric component of a composite bandpass filter.

A partial review of the polymers previously used in metal-polymer composites was given by S. F. Powellb M. J. Allen, and T. D. Willis in "Tin-polyimide and Indium-polyimide thin film composites as soft x-ray bandpass filters," *AppL Opt.* 32, 4855–4859 (1993).

A discussion of the rigidity (and the opposite of rigidity, which is flexibility) of a polyimide has been covered by C. P. Wong in a chapter entitled "Recent Advances in IC Passivation and Encapsulation: Process Techniques" in *Polymers for Electronic and Photonic Applications*, C. P. Wong, ed. (Academic Press, New York, 1993), p. 202. Polyimides derived from the dianhydride monomer pyromellitic dianhydride (PMDA) or 3,3',4,4'-biphenyltetracarboxylic acid dianhydride (BTCA) are rigid, while those synthesized from bis(3,4-dicarboxyphenyl) ether dianhydride (ODPA) are flexible. Polyimides constructed from benzidine or the diamine paraphenylenediamine (PPD) will be rigid, whereas those derived from 4,4'-diaminodiphenyl ether (ODA, or oxydianiline) will be flexible. ODPA and ODA are flexible because of the in-chain rotational movement allowed around the oxygen atom of the ether linkage. Additionally, these flexible polymers will by chemical definition contain oxygen because of the ether linkage. Rigid polymers are more desirable for x-ray filter and pressure window applications because of their superior strength (which in a thin film is most appropriately described by the film's biaxial modulus) and resistance to elongation.

There is no mention in the literature of a polymeric x-ray filter or pressure window fabricated from a polymer with a rigid configuration, similar to the polyimide BTCA-PPD, which is also oxygen-free. The importance of an oxygen-free "analog" or "variant" of the BTCA-PPD polyimide polymer will be discussed shortly.

The mechanical properties of an x-ray filter consisting of a thin film of a polymer or a metal-polymer composite may be enhanced by laminating the freestanding polymer film or metal-polymer composite to a wire screen or mesh. The use of a mesh supported, 1000 angstrom thick film of carbon as the entrance window for an x-ray microscope's proportional counter is discussed in Optical Systems for Soft X-Rays by A. G. Mchette, p. 261, Plenum Publishing Corporation (1986). Further discussion of the use of mesh to strengthen an x-ray filter is discussed in U.S. Pat. No. 5,261,977, entitled "Method of Fabricating Free-Standing Thin Films of Polyimide (issued Nov. 16, 1993). This patent is herein incorporated by reference.

"Freestanding," in this context, means that the film is mounted on a frame. A schematic diagram of a freestanding film has been shown in FIG. 6 of U.S. Pat. No. 5,261,977. A freestanding film is supported by the frame only at the film's edges, thus creating a central region of film that is not in direct contact with the frame. The central region of the film, in fact, is not in contact with any surface. "Freestanding" also refers to the fact that the film has been removed from the substrate on which the film had been cast, formed, or deposited. An appropriate thickness of the polymer film or metal-polymer composite, when it is freestanding and frame-supported, is five microns or less.

SUMMARY OF THE INVENTION

There is a need in the field of x-ray optics for an oxygen-free polymeric filter. This is because the mass absorption coefficient of oxygen is greater than that of carbon at every energy in the soft x-ray region except for a narrow band between the oxygen k-edge at 543.1 eV and the carbon k-edge at 284.2 eV. This band of frequencies is known as the "water window." First generation polymeric filter materials included polypropylene, poly(p-xylylene), and polycarbonate. Polycarbonate was probably stronger than its contemporary materials but had the disadvantage of containing nearly 20% by weight oxygen. As second generation materials, polyimides were significantly stronger than polycarbonates, but by chemical definition they too contain oxygen. The ideal filter material for use outside the 543.1 to 284.2 eV band would be an oxygen-free version of a polyimide. These polymers exist, and among the proposed "third generation" materials are the polybenzimidazoles (PBI's) and the polyphenylquinoxalines (PPQ's). The present invention is a method of filtering x-rays with the use of a freestanding, thin film of a polymer, metal-polymer composite, mesh-supported polymer film, or mesh-supported metal-polymer composite where the polymeric component of the filter is a PBI or a PPQ. In accordance with the present invention, the soft x-ray transmission of a 2500 angstrom polybenzimidazole film was measured at the Stanford Synchrotron Radiation Laboratory. The polybenzimidazole was roughly 3 to 5% more transmissive than either the polyimide DuPont 2610D or the polycarbonate GE Lexan.

OBJECTS AND ADVACTAGES

Figure 1:
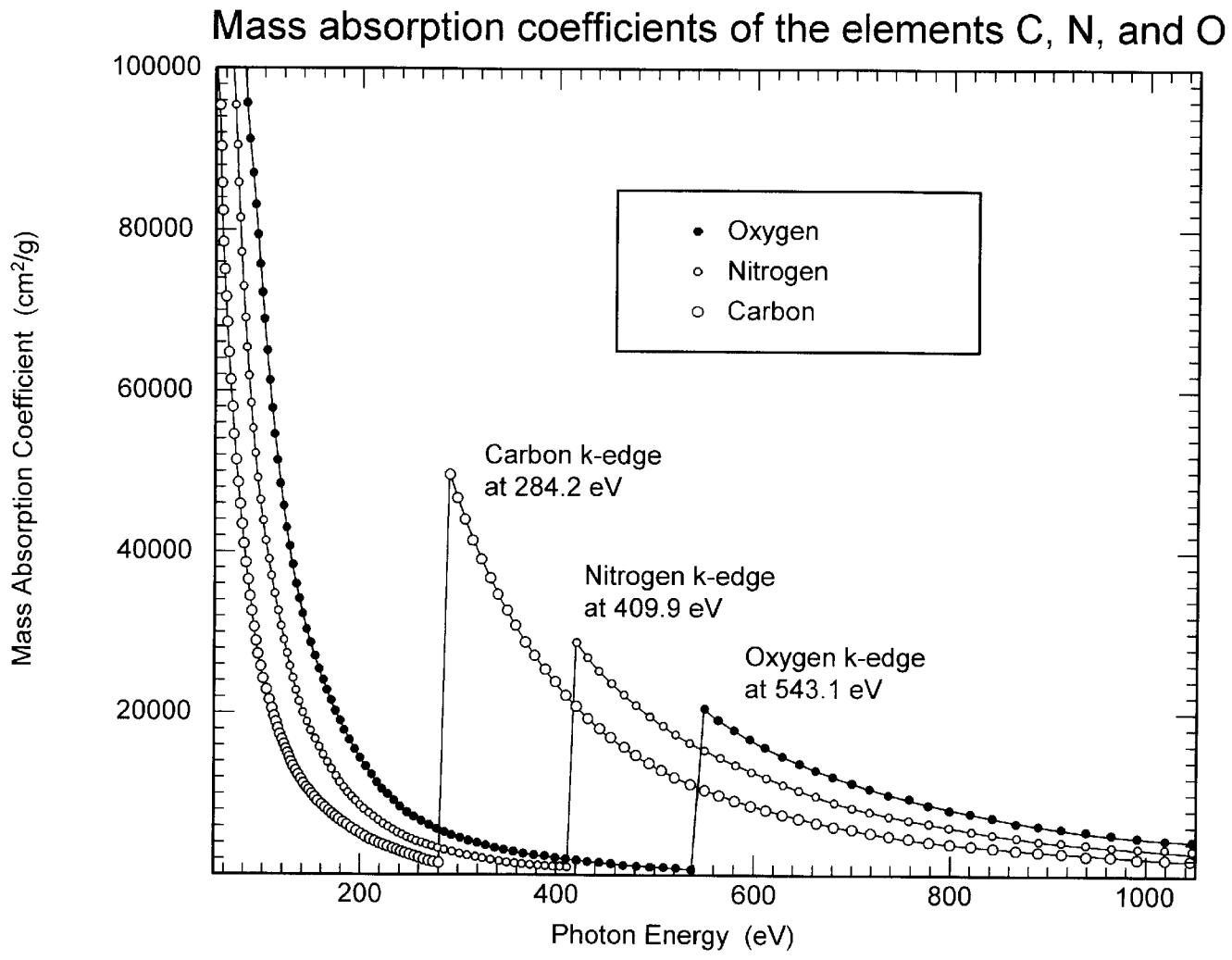
FIG. 1 is a plot of the mass absorption coefficients of the elements carbon, nitrogen, and oxygen as a function of energy, illustrating a reason for which a polymer containing no oxygen might be more transmissive than its oxygen-containing counterparts at all energies except those between 284.2 to 543.1 eV.

The mass absorption coefficients of elemental carbon, nitrogen, and oxygen have been plotted in FIG. 1 for energies between about 50 eV and about 1 keV (the mass absorption coefficients were obtained from a preprint by B. L. Henke, E. M. Gullikson, and J. C. Davis entitled "X-Ray Interactions: Photoabsorption, Scattering, Transmission and Reflection, 50–30,000 eV, Z=1–92," submitted to *Atomic Data and Nuclear Data Tables*, March, 1993). Because the mass absorption coefficient of oxygen is greater than that of carbon at all energies in the soft x-ray region except those within a narrow band between the oxygen k-edge at 543.1 eV and the carbon k-edge at 284.2 eV, a filter to be used outside this 543.1 to 284.2 eV band should be designed to be oxygen-free in order to maximize the transmission of the radiation impinging on the filter. "Oxygen-free" means that the polymeric component of the filter should contain little or no oxygen.

Conversely, filters destined to be used within the band should be designed to be rich in oxygen (contain as much oxygen as possible). The energy band within the two edges has been called the "water-window" region that is of particular interest to x-ray microscopists imaging live biological specimens. The carbon in a protein sample, for example, will absorb x-rays in the water window whereas the oxygen of the aqueous component of the solution does not absorb x-rays. This is what provides contrast for the microscope, and allows the protein to be imaged in its "live," hydrated state.

Figure 2:
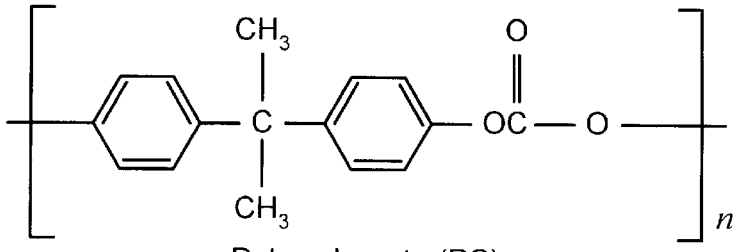
FIG. 2 depicts a typical chemical structure of a polycarbonate, a polyimide, a polybenzimidazole, a polyphenylquinoxaline, and a polybenzoxazole.
Figure 2:
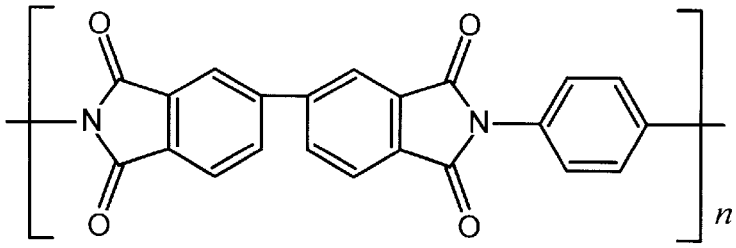
Figure 2:
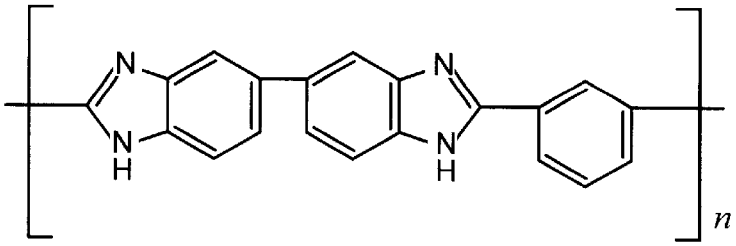
Figure 2:
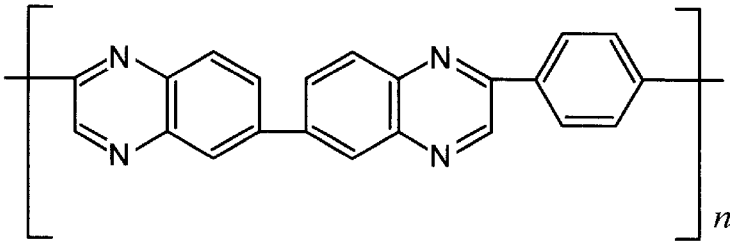
Figure 2:
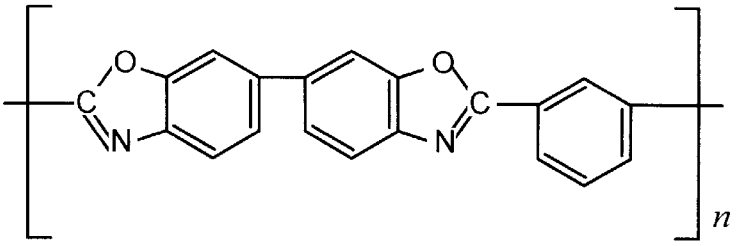

Adjusting the oxygen content of the polymeric component of an x-ray filter with respect to the wavelength (or energy) at which the filter will be used maximizes the transmission of the filter. Optimizing the optical properties by adjusting the oxygen content should be done while at the same time maintaining the superior mechanical characteristics of a rigid polymer. Several examples of how this may be accomplished are shown in FIG. 2. The BTCA-PPD polyimide shown in FIG. 2 is rigid, but contains oxygen in the form of carbonyl groups in the five-membered heterocyclic imide ring. The analagous polybenzimidazole, poly[2,2'-(m-phenylene) 5,5'-bibenzimidazole], is also shown in FIG. 2. This polybenzimidazole is oxygen-free and will have mechanical properties similar to the BTCA-PPD polyimide of FIG. 2. A second choice for an oxygen-free "analog" or "version" of the polyimide is the polyquinoxaline depicted in FIG. 2. This polymer is poly[2,2'-(p-phenylene) 6,6'-diquinoxaline]. For a given density, these oxygen-free materials will have higher transmissions than the BTCA-PPD polyimide when measured outside the 543.1 to 284.2 eV band. Since polyimides, polybenzimidazoles, and polyquinoxalines have similarly rigid chemical structures, they will similar mechanical properties.

If a rigid material is desired for use inside the 543.1 to 284.2 eV band, one choice is the polybenzoxazole shown in FIG. 2, which is poly[2,2'-(p-phenylene) 6,6'-bibenzoxaxole]. This polymer will also have the mechanical strength of a BTCA-PPD polyimide, and its oxygen content (in the form of non-carbonyl groups) makes it an appropriate filter for use inside the water window.

An object and advantage of this invention is that the oxygen-free nature of the PBI or PPQ chemical structure means that the transmission of the filter will be greater than that of the oxygen-containing counterparts of these polymers. A further object and advantage is that the oxygen-free materials have the mechanical strength of the oxygen-containing polyimide analog.

X-ray filters described in the prior art have not maximized transmission by adjusting the oxygen content of the polymeric component of the filter. In U.S. Pat. No. 4,933,557 (issued Jun. 12, 1990), and U.S. Pat. No. 4,960,486 (issued Oct. 2, 1990), R. T. Perkins, J. M. Thorne, L. V. Knight, and R. C. Woodbury describe a radiation detector window, one component of which in a preferred embodiment is a composite film of aluminium and the polymer poly(vinyl formal) (tradename Formvar, manufactured by Shawinigan Resins Corp. and Monsanto).

A disadvantage of the filter described in the perferred embodiment of U.S. Pat. No. 4,933,557 and U.S. Pat. No. 4,960,486 is the nearly 32 percent (by weight) oxygen content of Formvar (if this filter is to be used outside the 543.1 to 284.2 eV band "water window" of an x-ray microscope). A second disadvantage is that Formvar is not a thermally stable, rigid polymer containing aromatic rings in the "ladder" portion of the polymeric chain.

In U.S. Pat. No. 5,177,774 (issued Jan. 5, 1993), S. Suchewer, C. H. Skinner, and R. Rosser specify the use of a composite filter comprising 800 angstroms of aluminum and 100 angstroms of carbon for blocking the unwanted vacuum ultraviolet, ultraviolet, and visible radiation in an x-ray microscope operating at a wavelength of 182 angstroms (68.1 eV). This is an example of an x-ray microscope utilizing a carbon-containing x-ray filter for use outside the water window. The carbon component of this filter is graphitic carbon (which therefore contains no oxygen) but it is not expected to have the mechanical strength of a thermally stable, rigid, aromatic-type polymer layer of similar thickness.

In U.S. Pat. No. 5,204,887 (issued Apr. 20, 1993), M. Hayashida, Y. Watanabe, M. Niibe, T. Iizuka, and Y. Fukuda disclose the use of polyimide pressure windows in an x-ray microscope. The microscope is designed to operate at 5 nm (248 eV). Although the exact structure of the polyimide intended for use in this application was not disclosed, polyimides have in general roughly 18 to 20 percent oxygen (by weight), and contain carbonyl groups that generally force the requirement of a release agent for thin film production.

Polyimide foils are also used in the x-ray microscope of U.S. Pat. No. 5,222,113 (issued Jun. 22, 1993) invented by J. Thieme, B. Nieman, G. Schmahl and D. Rudolph. In this case however, the polyimide foils close off either one or both ends of a reflecting condenser to protect sensitive mirror surfaces against contamination. Because the polyimide foil is in the optical path of the microscope, the films must be as transmissive as possible. Again, the transmission of the windows used in this invention can be improved by substituting the oxygen-containing polyimide with an oxygen-free PBI or PPQ, with little or no loss of mechanical strength, if the microscope is to be used outside the water window.

The applications mentionned above pertain to x-ray telescopes and x-ray microscopes. In U.S. Pat. No. 5,204,886 (issued Apr. 20, 1993), Dugdale used a carbon filter ("thin carbon membrane") to eliminate unwanted long wavelength radiation in an x-ray lithography application. The carbon filter of this invention could be improved with the use of a PBI or PPQ filter for the reasons stated above.

A second application pertaining to x-ray lithography was disclosed by Nester in U.S. Pat. No. 4,246,054 (issued Jan. 20, 1981). Nester teaches that the polymers polyethylene teraphthalate (trademark Mylar) and the polyimide pyromellitic dianhydride/oxydianiline (PMDA/ODA, or trademark Kapton) may be used as masks in x-ray lithography. The mask must be as transparent to the x-radiation as possible. An oxygen-free PBI or PPQ mask will have a higher transmission than a PMDAIODA mask of equivalent thickness and density, with little or no loss of mechanical strength.

In U.S. Pat. No. 4,927,909 (issued May 22, 1990) and U.S. Pat. No. 5,017,681 (issued May 21, 1991) Wadhwa et al. discuss a process for producing continuous polybenzimidazole films. There is no mention of a utility for these films other than "high temperature applications." Wadhwa et al. do not disclose the usefulness of a PBI or PPQ x-ray filter.

In U.S. Pat. No. 5,114,579 (issued May 19, 1992), Takigawa used a polybenzimidazole membrane to separate metal ions from an aqueous solution. Takigawa does not disclose the usefulness of a PBI or PPQ x-ray filter.

DESCRIPTION OF THE INVENTION

Heretofore, investigators have used polypropylene, poly (p-xylylene), graphite, or phthalocyanine when needing an oxygen-free source of carbon to filter x-rays. The first two of these materials are reasonably strong, being polymers, but graphite is brittle and phthalocyanine is a dye with no mechanical integrity of its own. There is a need for a "rigid" polymer that contains only carbon and nitrogen, such that the material is oxygen-free, but which also contains aromatic rings in the "ladder" portion of the polymeric chain, so that the material has the mechanical properties and thermal stability similar to that of a polyimide. These materials exist and are the polybenzimidazoles (PBI's) and the polyphenylquinoxalines (PPQ's). A description of their chemistry may be found in numerous references, including *High Performance Polymers and Composites*, J. I. Kroschwitz, ed., (Wiley, New York, 1991), pp. 578–607 and 918–950, *Polymer Synthesis*, by S. R. Sandler and W. Karo, (Academic Press, New York, 1992), chapters 3 and 9, and *Thermally Stable Polymers* (Marcel Dekker, New York, 1980), by P. E. Cassidy, Chapters 5–9.

Structures of PBI and PPQ are shown in FIG. 2. The PBI depicted is poly[2,2'-(m-phenylene)-5,5'-bibenzimidazole], and this material is commercially available from Hoechst Celanese. An article elucidating the chemistry of this polybenzimidazole was written by E. J. Powers and G. A. Serad and is entitled "History and Development of Polybanzimidazole," *Symposium on the History of High Performance Polymers* (Am. Chem. Soc., New York, 1986).

The PPQ portrayed in FIG. 2 is poly[2,2'-(1,4-phenylene)-6,6'-diquinoxaline]. This material is predicted to have similar optical and mechanical properties to the PBI described above.

The polyimide that is analagous to the PBI and PPQ shown in FIG. 2 is synthesized from the monomers BTCA (3,3',4,4'-biphenyltetracarboxylic acid dianhydride) and PPD (para-phenylenediamine), and is sold under a variety of trademarks (DuPont 2610D, Hitachi L100, and Ube Industries Upilex S). The polycarbonate derived from the monomers bisphenol A and phosgene is shown for reference in FIG. 2. A material that is analagous to PBI which does not contain oxygen (and therefore would be appropriate inside the water window), but not oxygen in the form of carbonyl groups, is the polybenzoxazole (PBO) poly[2,2'-(m-phenylene)-6,6'-bibenzoxazole].

The elemental content of the nitrogen and oxygen in these polymers is:

| Polymer | Number of nitrogen atoms per repeat unit | Number of oxygen atoms per repeat unit |
|---|---|---|
| Polyimide | 2 | 4 |
| Polybenzimidazole | 4 | 0 |
| Polyphenylquinoxaline | 4 | 0 |
| Polybenzoxazole | 2 | 2 |

The physical properties of the BTCA-PPD polyitnide shown in FIG. 2 are characterized by the chemical bond linking the two phenyl groups of the dianhydride moiety (i.e., the two phenyl groups are not connected by a carbonyl or ether linkage, but rather by a carbon to carbon bond), and the single phenyl group that arises from the diamine group. This is what gives BTCA-PPD its rigidity and hence greater biaxial tensile strength. Rigid polymers avoid the use of ether linkages. An example of a polyimide with exceptionally high elongation is Hitachi PIQ-13, which has ether linkages in 50% of its dianhydride groups and 90% of its diamine groups (the structure of Hitachi PIQ-13 was reported by A. M. Wilson in "Polyimide insulators for multilevel interconnections," *Thin Solid Films* 83, 145–163, 1981).

An aromatic polyimide is defined by the —CO—N—CO—component of its five-membered heterocyclic rings (pictured in FIG. 2). Hence, by definition, a polyimide must contain oxygen, even if there are no ether or carbonyl linkages in the diamine and/or the dianhydride portions of the molecule. The carbonyl groups of the five-membered-rings in FIG. 2 not only add oxygen to the molecule, but enhance the adhesion of the polyimide film to the substrate onto which it is deposited. The configuration of the in-chain aromatic ring at the far right of each repeat unit (meta versus para) is not predicted to have a large effect on mechanical properties.

A PBI and/or PPQ film is, therefore, expected to have superior x-ray transmission relative to the analagous BTCA-PPD polyimide, with no decline in mechanical properties. Typical thicknesses of these films for use in x-ray filters are five microns or less.

Figure 3:
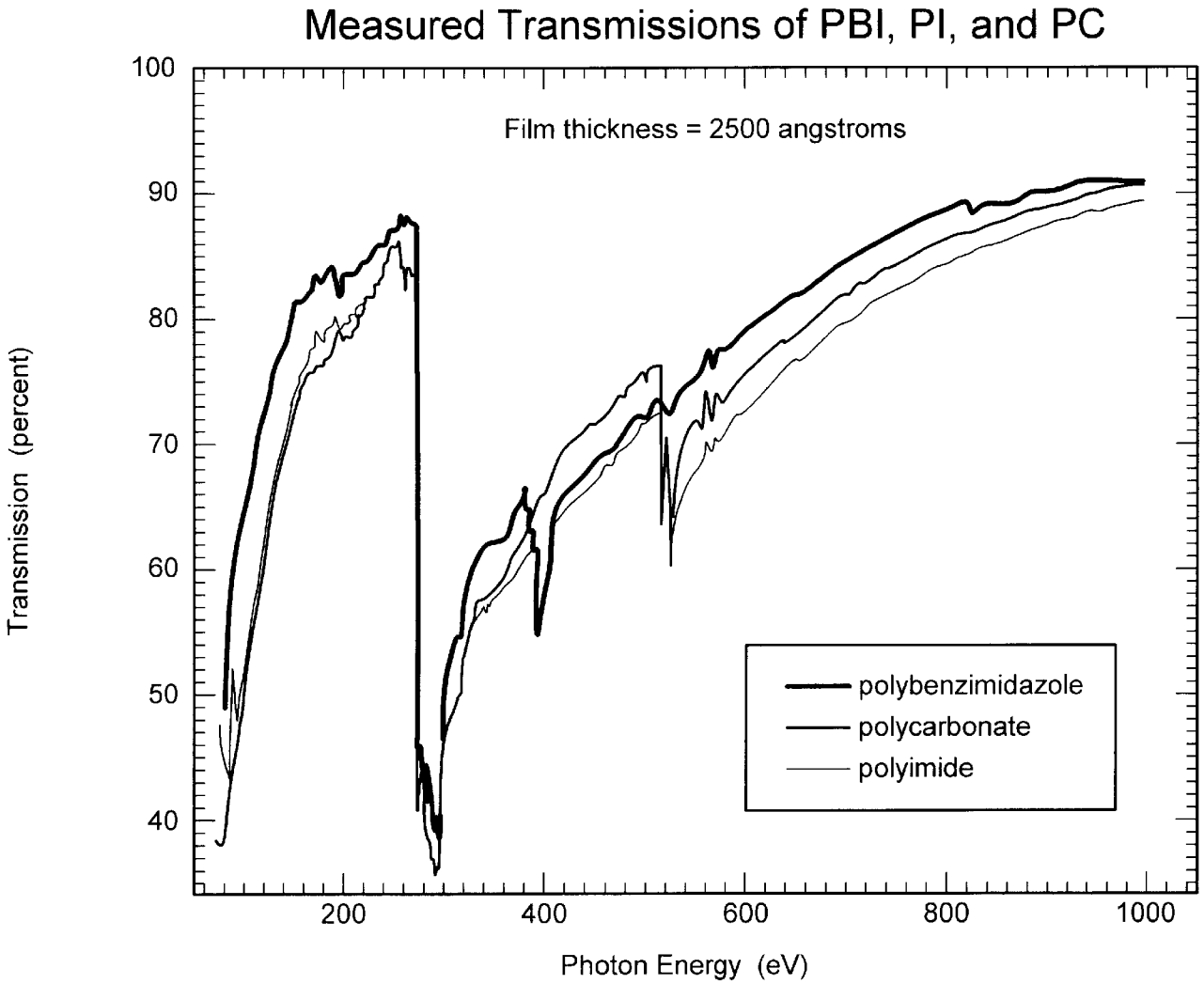
FIG. 3 shows some experimental results that confirm that a oxygen-free polybenzimidazole is more transmissive than an oxygen-containing polyimide or oxygen-containing polycarbonate at all energies except those between 284.2 to 543.1 eV.

The soft x-ray transmission of a PBI film was measured in the 100 eV to 1 keV spectral region at the Stanford Synchrotron Radiation Laboratory (SSRL). The results are shown in FIG. 3, along with the transmission of the analagous polyimide DuPont 2610D and the polycarbonate GE Lexan. The transmission of the PBI film was superior to that of either the polyimide or the polycarbonate by about 3 to 5% for all energies outside the water window.

The predicted transmissions of PBI, DuPont 2610D, and Lexan may be calculated using the relation $$\frac{I}{I_0} = e^{-\mu\rho t},$$

and mass absorption coefficients from Henke's 1993 tables. The densities of PBI, polyimide, and polycarbonate are 1.4, 1.4, and 1.2 g/cm$^3$, respectively.

A more general description of the structure of a polybenzimidazole has been given by Wadhwa et al. in U.S. Pat. Nos. 4,927,909 and 5,017,681. A polybenzimidazole repeat unit may be drawn in the following manner (n is the number of repeat units in the polymer chain):

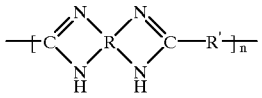

where R is a tetravalent aromatic hydrocarbon nucleus with the nitrogen atoms of the benzimidazole rings bonded to adjacent carbon atoms of the aromatic nucleus, such as a phenylene ring, a naphthalene ring, or a biphenylene moiety, and where R' is either (1) an aromatic hydrocarbon ring, (2) a plurality of aromatic hydrocarbon rings, (3) a fused, polycyclic aromatic hydrocarbon ring, (4) an alkylene group having from one to twenty carbon atoms, or (5) one of the following heterocyclic rings: (a) pyrrole, (b) imidazole, (c) pyrazole (d) pyridine, (e) pyrazine, (f) pyrimidine, (g) pyridazine, (h) triazine, (i) quinoline, (j) isoquinoline, (k) phthalazine, (l) naphthyridine, (m) quinoxaline, (n) quinazoline, or (o) cinnoline.

Examples of polybenzimidazoles consistent with the above drawn structure, and which function as release agents, are:

poly[2,2'-(ortho-phenylene)-5,5'-bibenzimidazole],
poly[2,2'-(meta-phenylene)-5,5'-bibenzimidazole],
poly[2,2'-(para-phenylene)-5,5'-bib enzimidazole],
poly[2,2'-(1",6"-naphthalene)-5,5'-bibenzimidazole],
poly[2,2'-(4",4"-biphenylene)-5,5'-bibenzimidazole],
poly[2,2'-(3",5"-pyridylene)-5,5'-bibenzimidazole],
poly[2,2'-octamethylene-5,5'-bibenzimidazole],
poly[2,2'-(2",5"-pyrrolylene)-5,5'-bibenzimidazole],
poly[2,2'-(m-phenylene)-5,5'-di(benzimidazole) methane],
poly[2,2'-(m-phenylene)-1",3"-phenylene-5,5'-bibenzimidazole],
poly[2,2'-(m-phenylene)-5,5'-bibenzimidazole], and
poly[2,5(6)-benzimidazole].

Similarly, the structure of a polyphenylquinoxaline repeat unit may be drawn as follows:

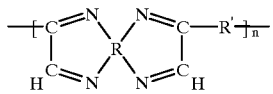

where R and R' have the same definitions as above.

EXAMPLE 1

A freestanding polybenzimidazole film was fabricated by mixing a solution of about 75% by weight PBI (15% by weight solids in DMAc) and 25% dimethylacetamide (DMAc). The particular polymer was poly[2,2'-(m-phenylene)-5,5'-bibenzimidazole] and is available from Hoechst Celanese Corporation. Films were cast by spincoating this solution onto 125 mm (in diameter) silicon wafer substrates at spin speeds of approximately 1500, 2500, and 3500 rpm using an Integrated Technologies model P-6204 spin coater in class 100 clean-room conditions. These spin speeds yielded thicknesses of about 1500, 2000, and 2500 Å, respectively. The films were dried by placing the silicon wafers into a vacuum oven pre-heated to about 110° C., with an argon blanket, for about 10 minutes. These films were released from the silicon wafer substrates by the "floating method" described by W. R. Hunter in *Physics of Thin Films* 7, 43–114 (1973) and by the "cemented frame" technique of U.S. Pat. No. 5,261,977. In both methods the film released from the silicon wafer almost immediately upon contact ii with the water bath. It was not necessary to heat the water bath. Releasing the film in a water bath also accomplished a "washing step," wherein excess solvent and the lithium chloride stabilizer is removed from the film (Hoechst Celanese adds about 2% by weight lithium chloride to the PBlldimethylacetamide solution to ensure that the polymer stays in solution when the solution is cooled to room temperature during their manufacturing process). In this, and all subsequent examples, the film's x-ray transmission was measured at a synchrotron radiation facility as mentioned above.

EXAMPLE 2

Polybenzimidazole films 1000 Å in thickness were spin-coated onto silicon wafer substrates similar to the method described in example 1. ApprQximately 1000 Å of aluminum was deposited onto one of the PBI films using a Plasma Sciences CRC-100 dc magnetron sputtering system. The aluminum was deposited onto the PBI film while the PBI film was still attached to the silicon wafer substrate. The aluminum-polybenzimidazole composite was released from the silicon wafer substrate using both the "floating method" and the "cemented frame" techniques described in example 1 and in the specification. This is an example of a case where the polymer film is part of a metal-polymer composite, and in this case the metal-polymer composite comprises the x-ray filter. The aluminum-PBI films released equally easily with either technique.

EXAMPLE 3

The procedure of example 2 was repeated using the metals titanium, vanadium, chromium, indium and tin. The composites of indium and tin with PBI did not release as easily as the titanium, vanadium, and chromium composites. Here again, the PBI polymer film is a part of a metal-polymer composite.

EXAMPLE 4

The procedure of example 1 was repeated with aluminum, titanium, chromium, palladium, silver, indium, and tin, except that this time the PBI film was metallized after the film was released from the substrate (in other words, the metals were sputtered onto the freestanding PBI film, where the PBI film is not supported by the substrate when the metals are being deposited). This procedure did not work as well for the metals titanium and chromium as it did for the metals aluminium, palladium, silver, indium, and tin.

EXAMPLE 5

X-ray filters were fabricated by attaching the freestanding polybenzimidazole and/or metal-polybenzimidazole composites to a wire screen or mesh. This created freestanding, frame mounted, and mesh supported films. The purpose of the mesh is to lend mechanical support to the polymer or metal-polymer film. The mesh in this example was a 70 line per inch (lpi) nickel mesh available from Buckbee Mears in St Paul, Minn.

I claim:

1. A method of filtering x-rays using a polymer film having recurring units of structure:

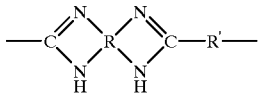

wherein R is a tetravalent aromatic hydrocarbon nucleus with the nitrogen atoms of the benzimidazole rings bonded to adjacent carbon atoms of said aromatic nucleus, and R' is selected from the group consisting of (1) an aromatic hydrocarbon ring, (2) a fused, polycyclic aromatic hydrocarbon ring, (3) an alkylene group having from one to twenty carbon atoms, and (4) a heterocyclic ring selected from the group consisting of (a) pyrrole, (b) imidazole, (c) pyrazole (d) pyridine, (e) pyrazine, (f) pyrimidine, (g) pyridazine, (h) triazine, (i) quinoline, (j) isoquinoline, (k) phthalazine, (l) naphthyridine, (m) quinoxaline, (n) quinazoline, and (o) cinnoline, wherein a freestanding film of said polymer is fabricated and then inserted into the optical path of x-ray or extreme ultraviolet radiation, thereby allowing said film to transmit a certain band of frequencies and filter out unwanted frequencies of the radiation impinging on said film.

2. A method of filtering x-rays wherein the polymer film of claim 1 is poly[2,2'-(m-phenylene)-5,5'-bibenzimidazole].

3. A method of filtering x-rays wherein the polymer film of claim 1 is part of a metal-polymer composite.

4. A method of filtering x-rays wherein the polymer film of claim 1 includes a supporting mesh layer.

5. A method of filtering x-rays wherein the polymer film of claim 1 is freestanding and frame mounted, and wherein the thickness of said polymer film is five microns or less.

6. A method of filtering x-rays wherein the polymer film of claim 1 is freestanding, frame mounted, and mesh supported, and wherein the thickness of said polymer film is five microns or less.

7. A method of filtering x-rays wherein the metal-polymer composite of claim 3 includes a supporting mesh layer.

8. A method of filtering x-rays wherein the metal-polymer composite of claim 3 is freestanding and frame mounted, and wherein the thickness of said metal-polymer composite is five microns or less.

9. A method of filtering x-rays wherein the metal-polymer composite of claim 3 is freestanding, frame mounted, and mesh supported, and wherein the thickness of said metal-polymer composite is five microns or less.

10. A method of filtering x-rays using a polymer film having recurring units of structure:

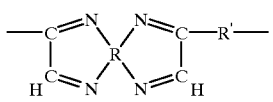

wherein R is a tetravalent aromatic hydrocarbon nucleus with the nitrogen atoms of the benzimidazole rings bonded to adjacent carbon atoms of said aromatic nucleus, and R' is selected from the group consisting of (1) an aromatic hydrocarbon ring, (2) a fused, polycyclic aromatic hydrocarbon ring, (3) an alkylene group having from one to twenty carbon atoms, and (4) a heterocyclic ring selected from the group consisting of (a) pyrrole, (b) imidazole, (c) pyrazole (d) pyridine, (e) pyrazine, (f) pyrimidine, (g) pyridazine, (h) triazine, (i) quinoline, (j) isoquinoline, (k) phthalazine, (l) naphthyridine, (m) quinoxaline, (n) quinazoline, and (o) cinnoline, wherein a freestanding film of said polymer is fabricated and then inserted into the optical path of x-ray or extreme ultraviolet radiation, thereby allowing said film to transmit a certain band of frequencies and filter out unwanted frequencies of the radiation impinging on said film.

11. A method of filtering x-rays wherein the polymer film of claim 10 is poly[2,2'-(1,4-phenylene)-6,6'-diquinoxaline].

12. A method of filtering x-rays wherein the polymer film of claim 10 is part of a metal-polymer composite.

13. A method of filtering x-rays wherein the polymer film of claim 10 includes a supporting mesh layer.

14. A method of filtering x-rays wherein the polymer film of claim 10 is freestanding and frame mounted, and wherein the thickness of said polymer film is five microns or less.

15. A method of filtering x-rays wherein the polymer film of claim 10 is freestanding, frame mounted, and mesh supported, and wherein the thickness of said polymer film is five microns or less.

16. A method of filtering x-rays wherein the metal-polymer composite of claim 12 includes a supporting mesh layer.

17. A method of filtering x-rays wherein the metal-polymer composite of claim 12 is freestanding and frame mounted, and wherein the thickness of said metal-polymer composite is five microns or less.

18. A method of filtering x-rays wherein the metal-polymer composite of claim 12 is freestanding, frame mounted, and mesh supported, and wherein the thickness of said metal-polymer composite is five microns or less.

* * * * *